US007585085B1

(12) United States Patent
Holman

(10) Patent No.: US 7,585,085 B1
(45) Date of Patent: Sep. 8, 2009

(54) SOLAR LIGHT SIGN POST

(76) Inventor: Jeffrey Tedd Holman, 3538, Mendenhall Ct., Pleasanton, CA (US) 94588

( * ) Notice: Subject to any disclaimer, the term of this patent is extended or adjusted under 35 U.S.C. 154(b) by 199 days.

(21) Appl. No.: 11/584,937

(22) Filed: Oct. 23, 2006

Related U.S. Application Data

(60) Provisional application No. 60/729,518, filed on Oct. 24, 2005.

(51) Int. Cl.
*F21V 33/00* (2006.01)
*F21L 13/00* (2006.01)

(52) U.S. Cl. ..... 362/183; 362/154; 40/541

(58) Field of Classification Search ..... 362/154, 362/155, 183; 40/541
See application file for complete search history.

(56) References Cited

U.S. PATENT DOCUMENTS

| | | | | |
|---|---|---|---|---|
| 4,005,537 | A | 2/1977 | Von Camber et al. | |
| 4,299,043 | A | 11/1981 | Lathrop et al. | |
| 4,319,310 | A * | 3/1982 | Kingsley | 362/183 |
| 4,718,185 | A | 1/1988 | Conlin et al. | |
| 4,843,525 | A | 6/1989 | Williams | |
| 5,036,442 | A * | 7/1991 | Brown | 362/102 |
| 5,101,329 | A * | 3/1992 | Doyle | 362/183 |
| 5,467,076 | A * | 11/1995 | Ruocco et al. | 340/571 |
| D378,143 | S | 2/1997 | Kollins | |
| D379,545 | S | 5/1997 | Houghton et al. | |
| 5,813,749 | A * | 9/1998 | Sheldon | 362/155 |
| 6,004,002 | A * | 12/1999 | Giannone | 362/183 |
| 6,263,601 | B1 | 7/2001 | Emert | |
| 6,509,204 | B2 * | 1/2003 | Campbell | 438/97 |
| 6,604,840 | B2 | 8/2003 | Watson | |
| 2004/0177538 | A1 | 9/2004 | De Ruyter et al. | |
| 2006/0185203 | A1 * | 8/2006 | Bittle et al. | 40/541 |
| 2007/0193088 | A1 * | 8/2007 | Lemberger et al. | 40/544 |
| 2007/0261280 | A1 * | 11/2007 | Rastegar | 40/541 |
| 2008/0278934 | A1 * | 11/2008 | Maldonado | 362/183 |

FOREIGN PATENT DOCUMENTS

| | | |
|---|---|---|
| CA | 2209867 | 2/1999 |

* cited by examiner

*Primary Examiner*—Stephen F Husar
*Assistant Examiner*—James W Cranson
(74) *Attorney, Agent, or Firm*—Jeffrey T. Holman

(57) ABSTRACT

Embodiments of a solar lighting apparatus and method.

19 Claims, 14 Drawing Sheets

SOLAR LIGHT SIGN POST

CROSS-REFERENCE TO RELATED APPLICATIONS

This application claims the benefit of priority of U.S. Provisional Patent Application 60/729,518, filed on Oct. 24, 2005, and U.S. patent application Ser. No. 11/514,760, filed on Sep. 1, 2006.

BACKGROUND

Solar lighting is a renewable source of energy. Over the years, solar lighting components are becoming more compact and more efficient, allowing solar lighting components to be incorporated into new devices and to implement new applications.

One specific area of solar innovations is in solar lighting products to light signage such as real estate "for sale" signs. However, currently available solar light devices for signage suffer from many disadvantages. Foremost, many conventional solar lighting devices are bulky or otherwise distract from the traditional and professional image of real estate signs. For example, many conventional solar lighting products are made to attach to the sign post or directly to the sign. In this way, a substantial portion of the solar lighting product typically increases the profile of the sign/post system, or extends away from the sign/post like a foreign appendage. Because they are mounted in an exposed manner on the sign and/or post, these conventional solar lighting devices are also prone to theft, abuse, or damage. Specific types of conventional solar lighting devices have additional problems.

BRIEF DESCRIPTION OF THE DRAWINGS

A more particular description of embodiments of the invention is provided herein by reference to specific embodiments that are illustrated in the appended drawings.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of the embodiments may be combined in any suitable manner in one or more embodiments. In the following description, numerous specific details are provided to provide a thorough understanding of embodiments of the invention. One skilled in the relevant art will recognize, however, that some embodiments of the invention may be practiced without one or more of the specific details, or with other methods, components, materials, and so forth. In other instances, well-known structures, materials, or operations are not shown or described in detail to avoid obscuring aspects of the invention.

Figure 1A:
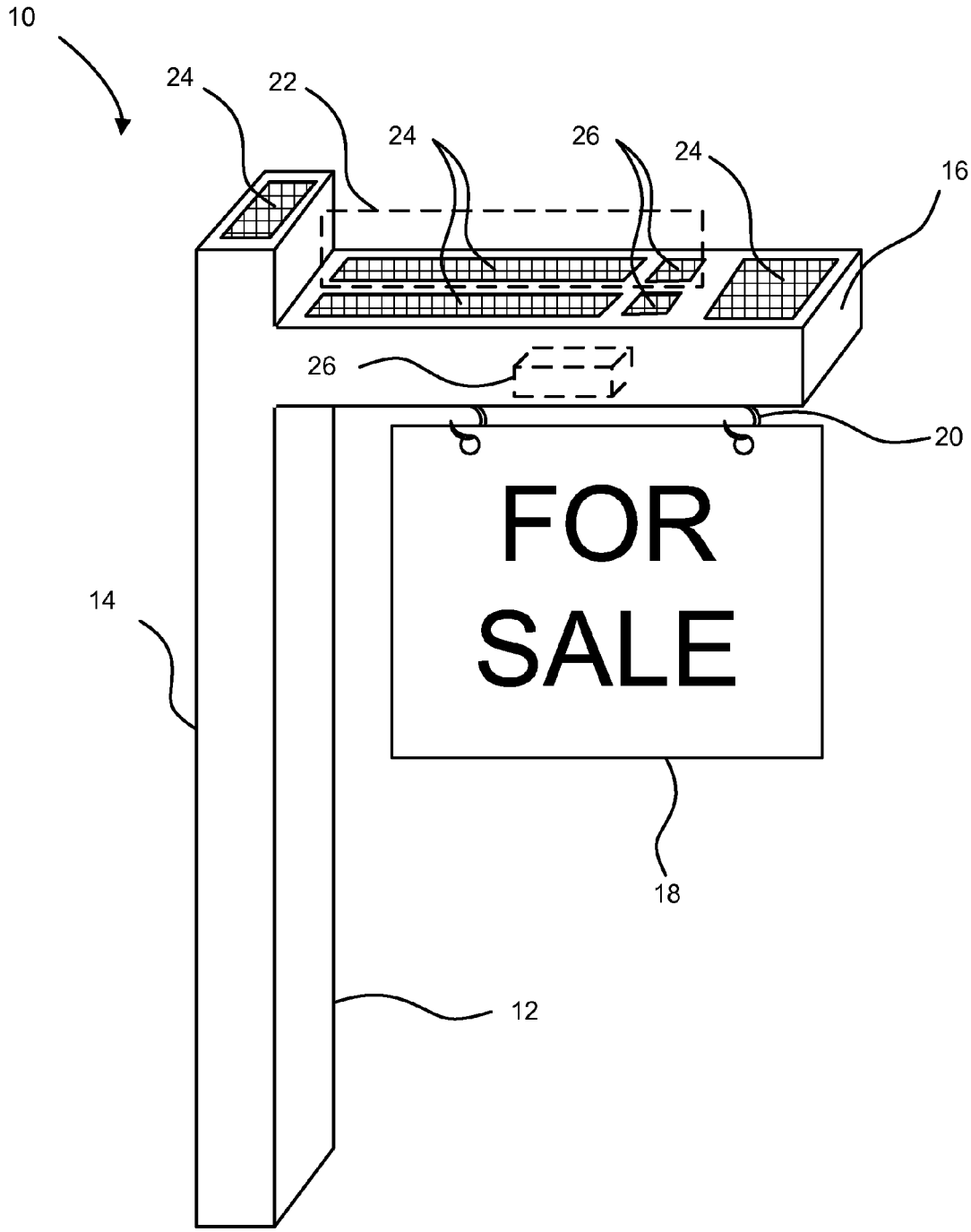
FIG. 1A is a schematic diagram illustrating one embodiment of a solar light sign post.

FIG. 1A depicts one embodiment of a solar light sign post 10. The illustrated solar light sign post 10 includes a post 12 having a vertical member 14 and a horizontal member 16. Alternative embodiments may include other vertical or horizontal members. The horizontal member 16 is also referred to as a crossarm. A listing sign 18 or other type of sign may be attached to the crossarm 16 using sign hardware 20. For example, conventional sign hanging hardware 20 includes eye-hooks attached to the underside of the crossarm 16 and "S" hooks which hang the sign 18 from the eye-hooks. In certain embodiments, the sign 18 may be a conventional real estate "For Sale" sign or a "For Rent" sign such as a metal or corrugated plastic sign. Other types of sign hardware 20 and signs 18 may be used with the solar light sign post 10. Furthermore, the crossarm 16 may have a mounting location and/or hardware for a rider sign 22 (shown dashed) on the topside of the crossarm 16.

In one embodiment, the sign post 12 is manufactured of vinyl, aluminum, steel, or another material that forms a hollow interior. Alternatively, the sign post 12 may be a solid material such as wood. Additionally, the sign post 12 may have cross-sectional dimensions similar to conventional sign posts. For example, the cross-section of the sign post 12 may be between approximately one inch square (1" by 1") and six inches square (6" by 6") or a rectangular variation within the range of one to six inches. Some conventional sign posts include one inch tubular steel sign posts, 3×2¼ aluminum sign posts, and trade size 4×4 wood sign posts, all of which may be generally referred to as swingposts. Other types of sign posts include A-frames, H-frames, and other well-known sign frames. Reference herein to a specific type of sign post 12 or frame is meant to generally refer to sign posts or frames, unless indicated otherwise in the text or context.

Figure 1B:
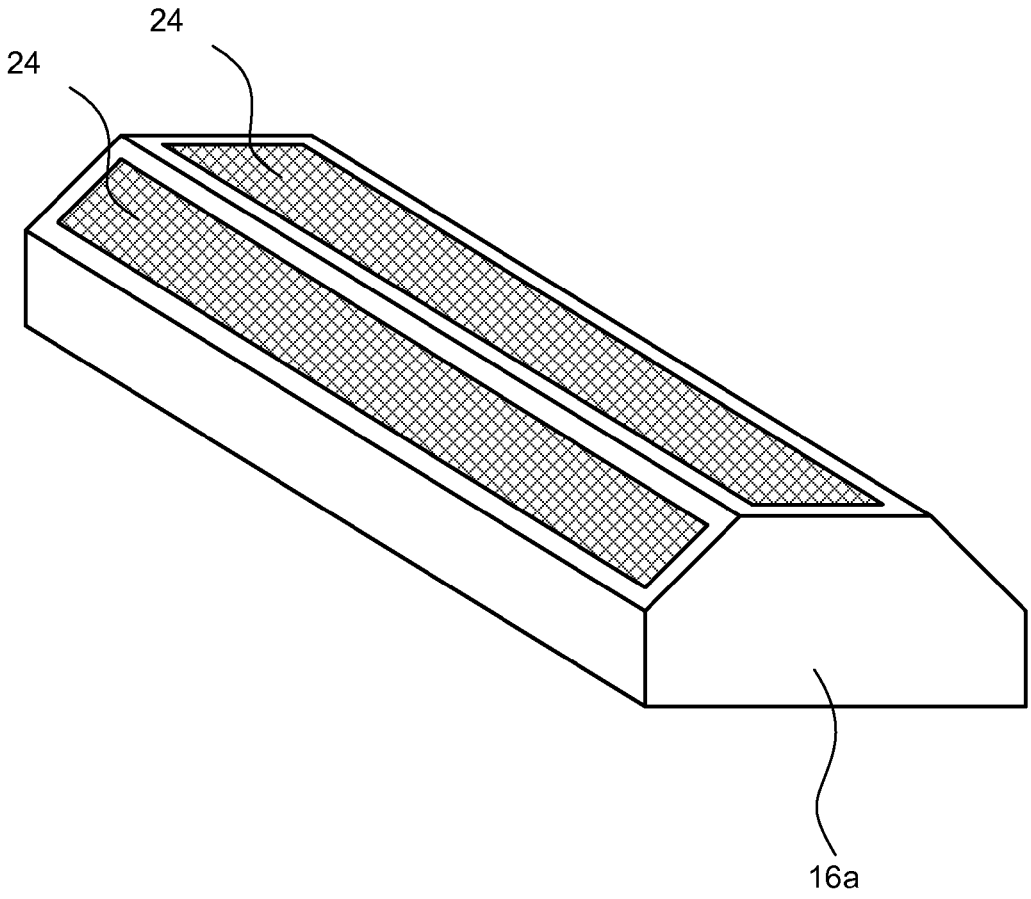
FIG. 1B is a schematic diagram illustrating one embodiment of a non-rectangular crossarm.

The illustrated solar light sign post 10 includes one or more solar panels 24, or solar cells, that collect solar energy and generate electrical energy. Several optional locations are shown for the one or more solar panels 24. For example, a solar panel 24 may be located on the top of the vertical member 14. In another embodiment, a solar panel 24 may be located in the center of or off-center along the topside of the crossarm 16. In another embodiment, one or more solar panels 24 may be located on either or both sides of the rider sign location 22 along the topside of the crossarm 16. Although specific locations are illustrated, other locations and combinations of locations may be implemented in a particular solar light sign post 10. The use of certain locations may depend in part on the size and configuration of the sign post 12, including the crossarm 16. For, example, where a crossarm with a non-rectangular cross-section 16*a*, as shown in FIG. 1B, is implemented, the solar panels 24 may be mounted on surfaces that are not completely horizontal or vertical. In one embodiment, a solar panel 24 may be mounted on an angled portion of the crossarm 16*a* so that the solar panel 24 is mounted at an angle such as 45 degrees (or another angle between zero and 90 degrees) relative to a horizontal position. Furthermore, the solar panels 24 may be mounted on top of or partially or wholly recessed within the corresponding member of the sign post 12. In the case of a hollow member such as a vinyl crossarm 16, recessing may be accomplishing by cutting or otherwise forming a whole in the crossarm 16 and locating the solar panel 24 within the hole. In the case of a solid member such as a 4×4 wood crossarm 16, recessing may be accomplished by constructing the member with a recess or by forming the recess through routing the recess into the member or otherwise forming the recess.

The illustrated solar light sign post 10 also includes one or more lights 26 and associated circuitry (not shown) to electrically couple the solar panel(s) 24 and the lights 26. In one embodiment, one or more lights 26 may be mounted on or recessed into the underside of the crossarm 16 and oriented to project light onto the listing sign 18 or other sign mounted to the underside of the crossarm 16. In another embodiment, one or more lights 26 may be mounted to the topside of the crossarm 16 to project light onto the rider sign 22. In another embodiment, one or more lights 26 may be mounted to one or both sides of the crossarm 16, the end of the crossarm 16, or any other location on the sign post 12, including the vertical member 14.

The circuitry may include wires, circuitboards, transistors, batteries, connectors, and other electrical components that may be used to connect the one or more solar panels 24 to the one or more lights 26. In one embodiment, the lights 26 may be light emitting diodes (LEDs). Alternatively, the lights 26 may be another type of light source. In one embodiment, the batteries store the electrical energy generated by the solar panels 24 and, at an appropriate time, send the electrical energy to the lights 26. In one embodiment, the lights 26 and circuitry are configured to allow the lights 26 to remain off during approximately daylight hours and to allow the lights 26 to turn on and remain on during approximately the nighttime hours. In one embodiment, the lights 26 turn on or off depending on the ambient light as determined through a photocell (not shown) or other type of light detector such as the solar panels 24 themselves. In another embodiment, the lights 6 turn on or off depending on other circuitry such as a timer (not shown). Additionally, the circuitry may include programming circuitry to program the lights 26 to turn on or off according to a preset program, such as blinking, fading, strobing, and so forth. Additionally, where multiple lights 26 are used, the lights 26 may be controlled individually or in groups. Additionally, the lights 26 may include multiple colors. In one embodiment, the lights 26 are superbright white LEDs and the batteries are rechargeable batteries.

FIG. 1B is a schematic diagram illustrating one embodiment of a non-rectangular crossarm 16*a*. In other words, some embodiments may implement a sign post 12 with a crossarm 16*a* with a non-rectangular cross-section. For example, the crossarm 16*a* may have a trapezoidal cross-section, or another polygonal or partially curved cross-section. Implementing a non-rectangular crossarm 16*a* may permit various placement locations for the solar panels 24.

Figure 2:
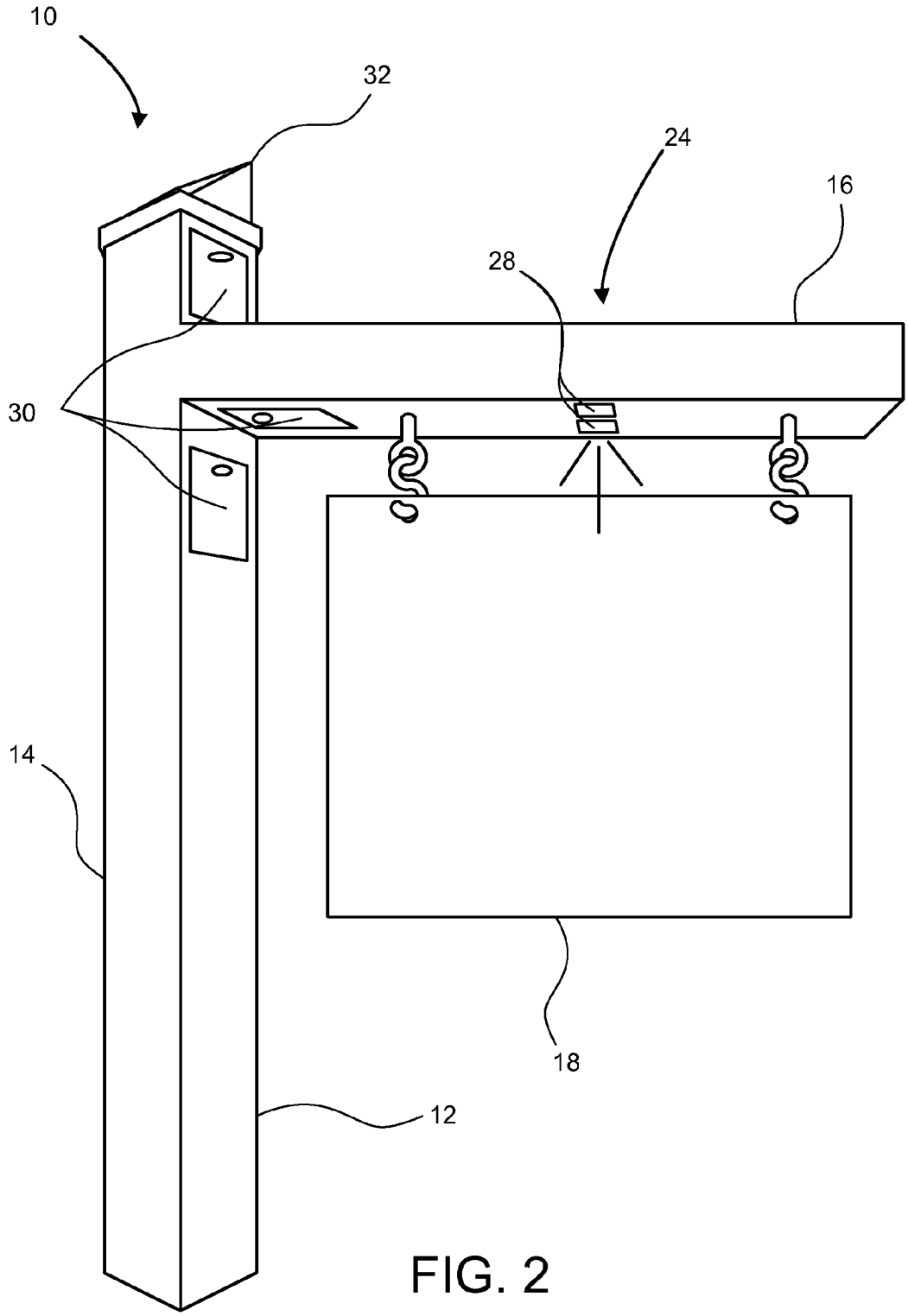
FIG. 2 is a schematic diagram illustrating another embodiment of a solar light sign post.

FIG. 2 depicts another embodiment of a solar light sign post 10. The depicted solar light sign post 10 is similar in some aspects to the solar light sign post 10 of FIG. 1A. The solar light sign post 10 of FIG. 2 is shown from a different vantage point to illustrate multiple lights 26 on the underside of the crossarm 16. In certain embodiments, the lights 26 may be protected by one or more lenses 28, flanges, seals, or other protective components.

The illustrated solar light sign post 10 includes one or more battery compartments (internal to the sign post 12) having an access door 30. The access door 30 may be held closed by a screw or other fastener. As shown, the access door 30 may be on the vertical member 14 or on the crossarm 16. In other embodiments, the access door 30 may be on another part of the sign post 12. In a particular embodiment, the battery compartment may be accessible under another solar light device such as a solar panel 24. For example, the battery compartment may be accessible by removing a solar panel 24 or opening a compartment covered by a solar panel 24. In the case of a hollow sign post 12, the battery compartment may be located within the hollow core of the sign post 12, either attached to the sign post 12 or unattached (resting on) a part of the sign post 12. The battery compartment also may be referred to as a power storage module.

FIG. 2 also illustrates an inclined, rotatable solar panel post cap 32 mounted on the vertical member 14 of the sign post 12. One example of a solar panel post cap 30 is shown and described in more detail with reference to FIGS. 4 and 5 below.

Figure 3:
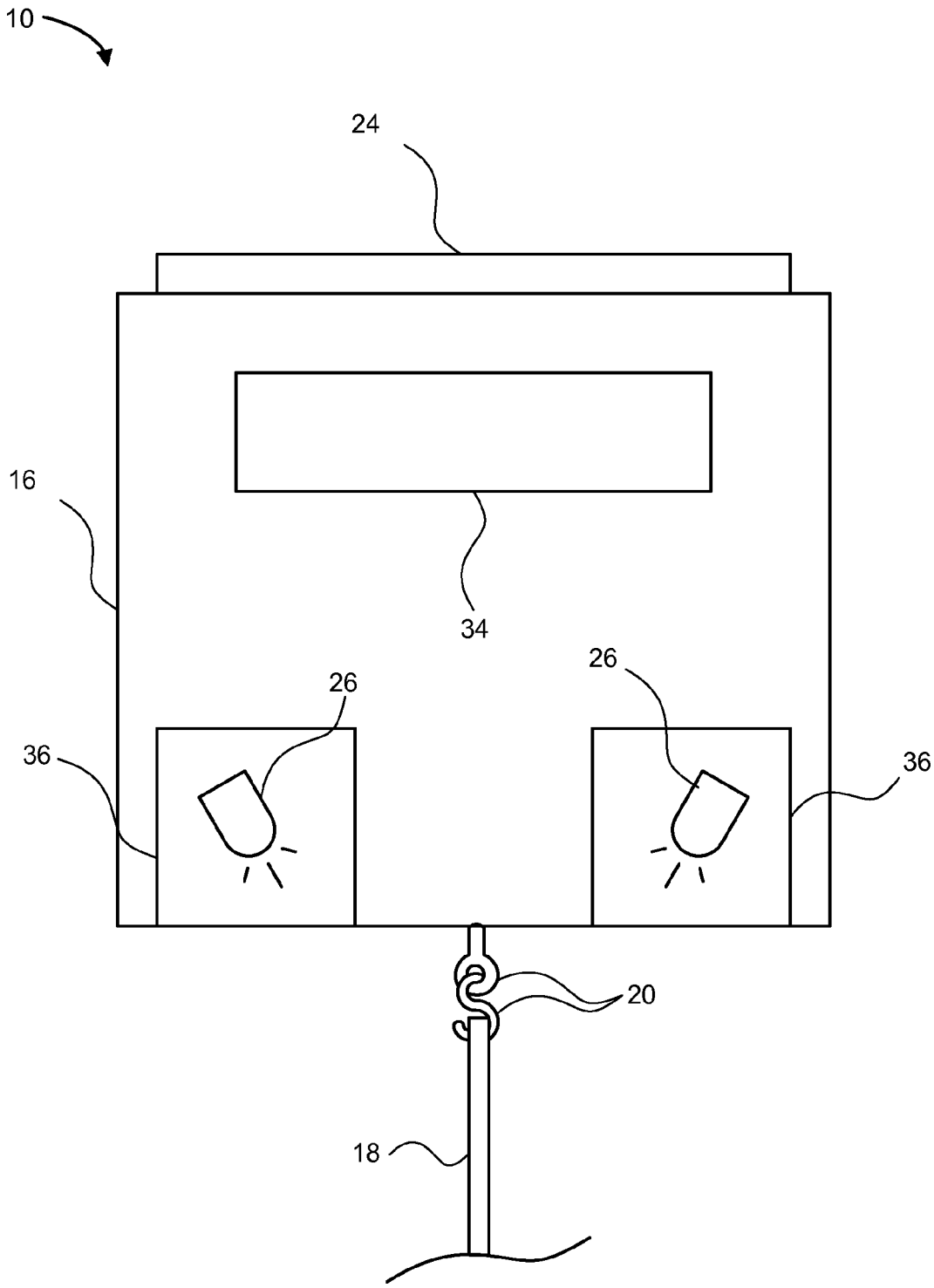
FIG. 3 is a schematic diagram illustrating a cross-sectional view of a solar light sign post.

FIG. 3 depicts a cross-sectional view of a solar light sign post 10. The illustrated solar light sign post 10 is substantially similar to the solar light sign posts 10 of FIGS. 1A and 2. The illustrated solar light sign post 10 includes a solar panel 24 that is located on the topside of the crossarm 16, a battery compartment 34 within the hollow core of the crossarm 16, and two light housings 36 recessed within the underside of the crossarm 16. In another embodiment, the light housings 36 may partially or wholly extend from the core of the crossarm 16. Each light housing 36 may have one or more lights 26 such as LEDs and/or lenses 28. In another embodiment, the solar light sign post 10 may include a single light housing 36 with LEDs 26 in approximately the same position and orientation in relation to the sign. In another embodiment, the lights 26 may be clustered or distributed within one or more light housings 36. For example, a cluster of three LEDs 26 may be attached to a single circuitboard (not shown) and positioned approximately at the horizontal center of the hanging sign 18. As another example, a bar of LEDs 26 may be positioned parallel to the crossarm 16 and sign 18 to light a side of the sign 18. Although omitted for clarity, one or more wires, circuitboards, or other circuitry may be included to electrically couple the solar panel 24, battery compartment 34, and light housing(s) 36.

Alternatively, the lights 26 may be installed within the internal compartment of the crossarm 16 without using a light housing 36. For example, one or more bars of LEDs 26 may be glued or otherwise fastened to an interior surface of the crossarm 16. In another embodiment, the LEDs 26 may be mounted to the lens 28, which may be fastened to the crossarm 16.

Figure 4:
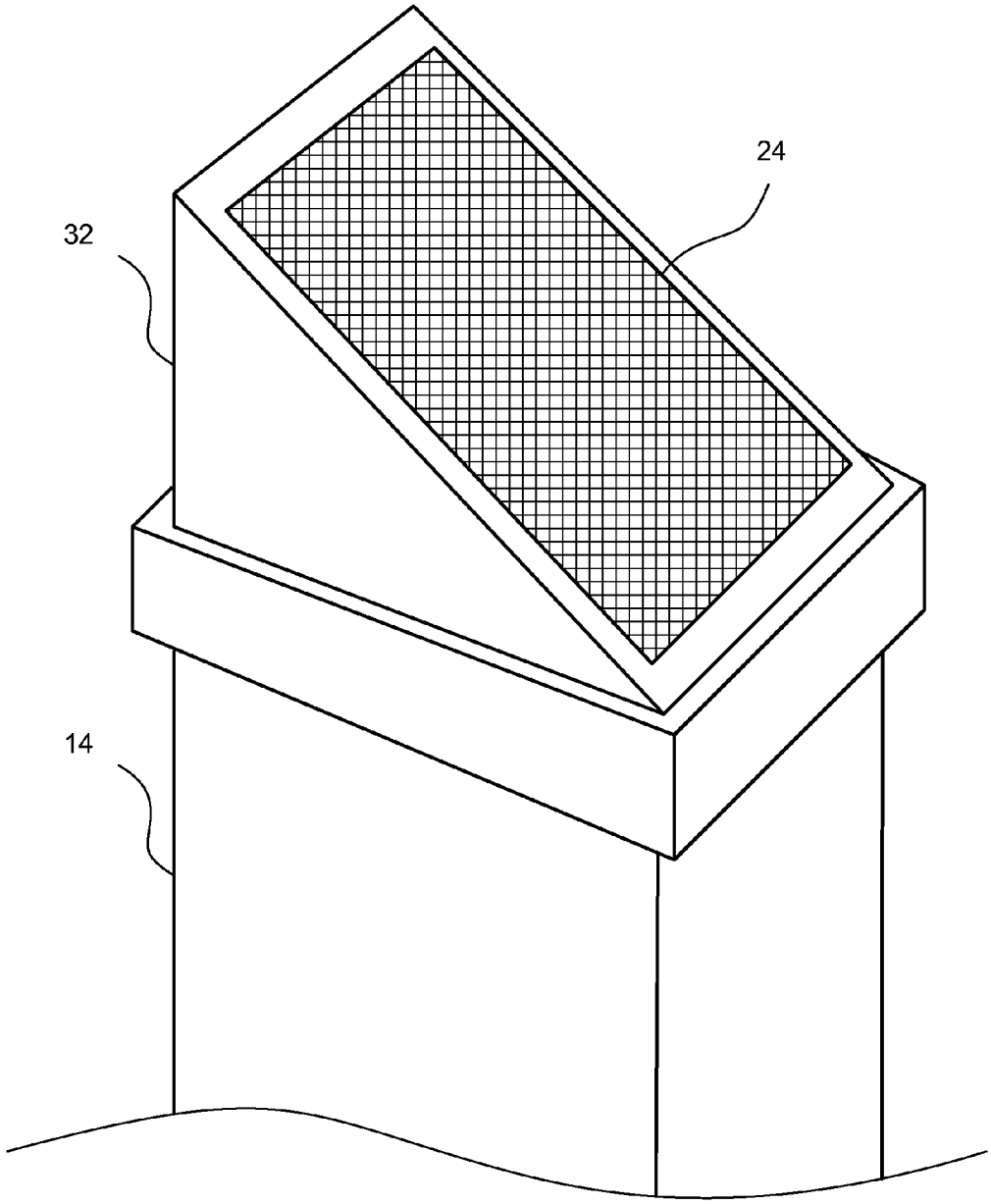
FIG. 4 is a schematic diagram illustrating one embodiment of an inclined solar post top.

FIG. 4 depicts one embodiment of an inclined solar post top 32. The inclined solar post top 32 is at an angle with respect to the vertical and horizontal planes. In one embodiment, the incline may be approximately equal to an angle that might position the solar panel 24 approximately perpendicular to the location of the sun (not shown). The inclined solar panel post top 32 may be fixed or rotatable with respect to the vertical member 14 of the sign post 12. One example of a rotatable inclined solar post top 32 is shown and described in more detail with reference to FIG. 5.

Figure 5:
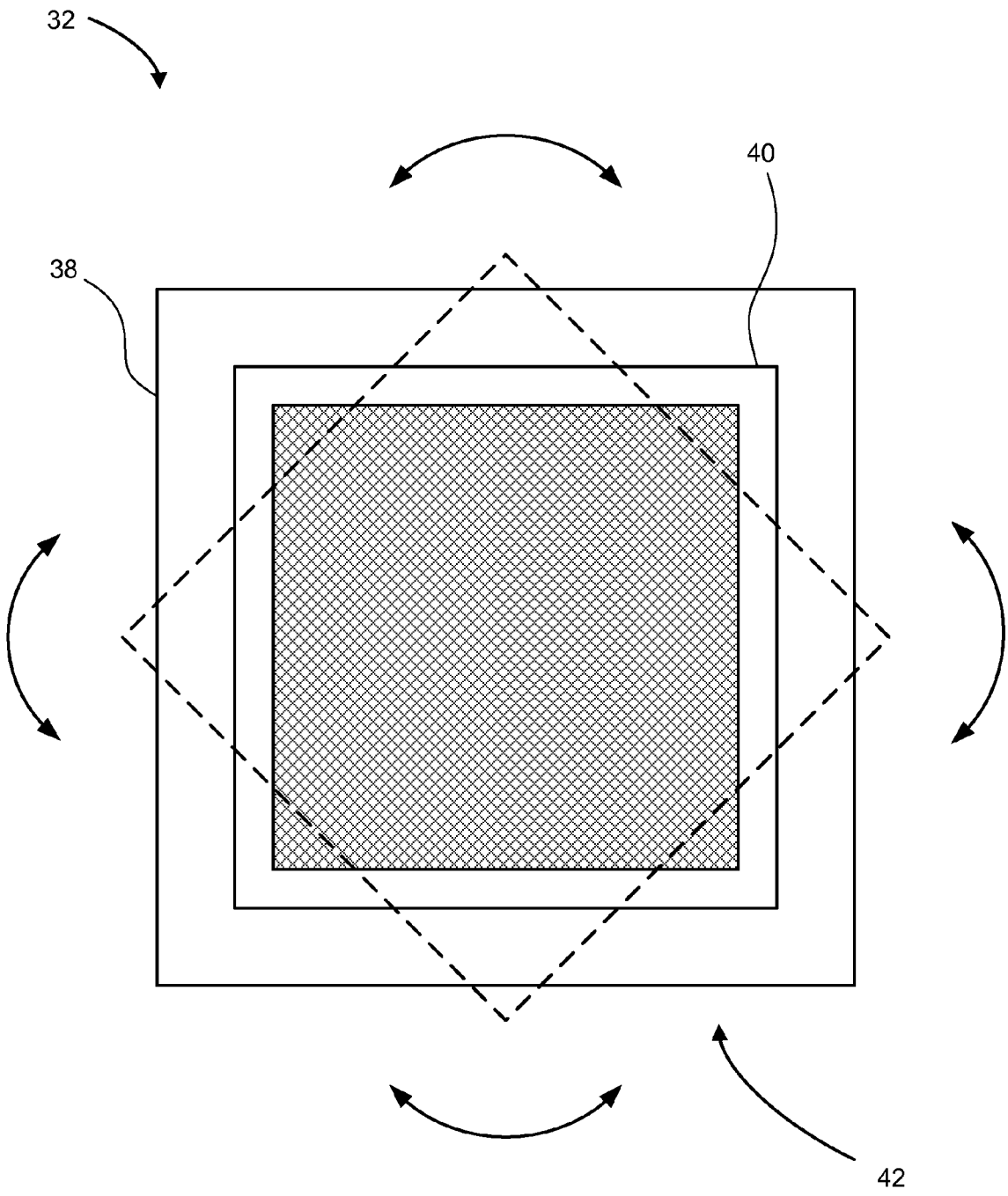
FIG. 5 is a schematic diagram illustrating a top view of the inclined solar post top of FIG. 4.

FIG. 5 depicts a top view of the inclined solar post top 32 of FIG. 4. In one embodiment, the solar post top 32 includes a fixed base 38 and a rotatable top 40. The fixed base 38 may be rigidly fixed to the top of the vertical member 14, and the rotatable top 40 may be rotated relative to the fixed base 38. The solar post top 32 is shown in a first position (solid) and a second position (dashed). The second position is rotated approximately 45 degrees from the first position as indicated by the arrows. In one embodiment, the solar panel post top 32 may include a mechanical stop 42 to prevent rotation of the post top 32 more than approximately one revolution. For example, the stop 42 may allow the solar post top 32 to rotate a maximum of approximately 359 degrees, in one embodiment.

Figure 6:
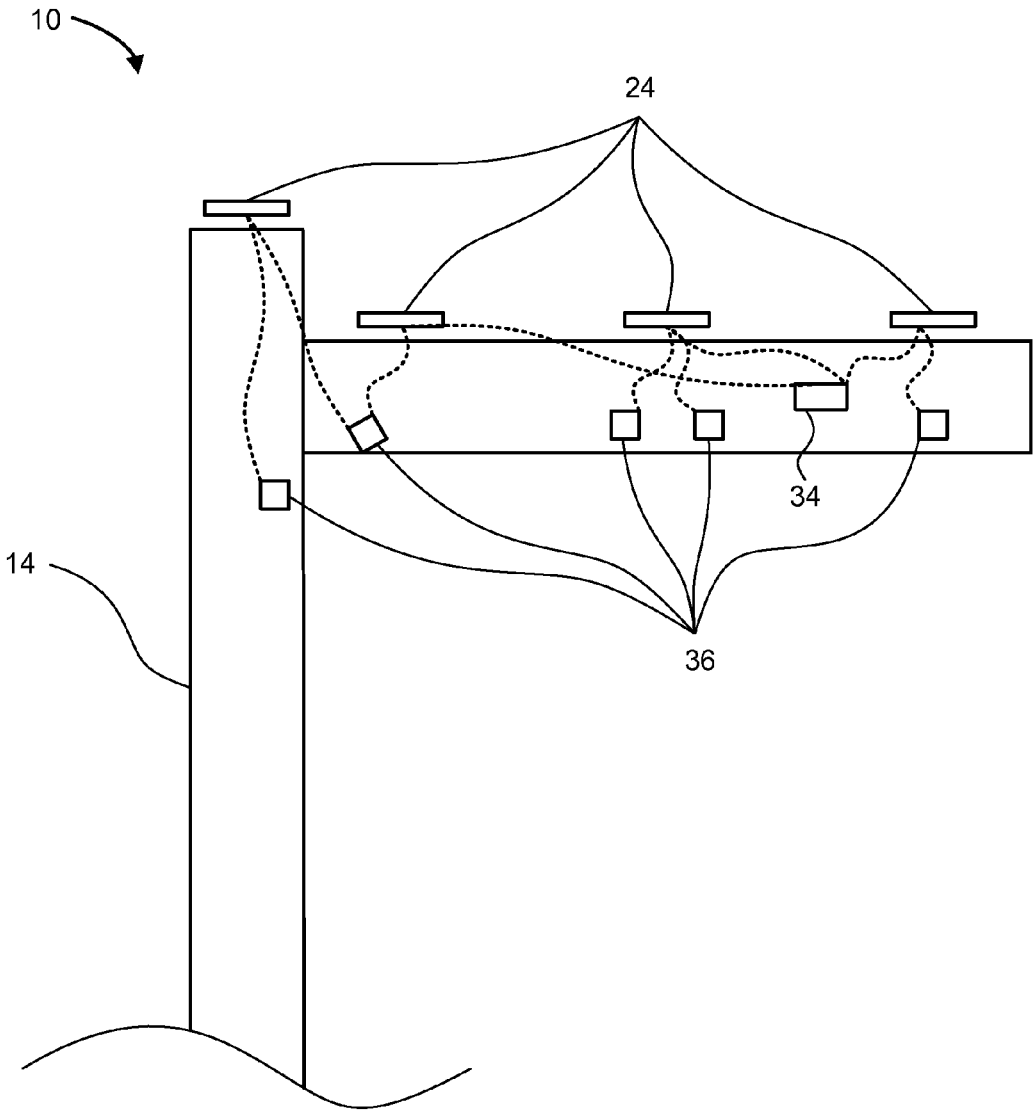
FIG. 6 is a schematic diagram illustrating several potential locations of a solar panel and one or more lights on a solar light sign post.

FIG. 6 depicts several potential locations of one or more solar panels 24 and one or more lights 26 on a solar light sign post 10. The solar panel(s) 24 may be located on the top of the vertical member 14 or the top of the horizontal member 16. In other embodiments, the solar panel(s) 24 potentially may be mounted on a side or other location of the vertical or horizontal members 14 and 16. In another embodiment, the solar panel(s) 14 may be mechanically coupled to one of the members of the sign post 12. Similarly, the light(s) 26 may be location on the vertical member 14, the horizontal member 16, or both. In one embodiment, the light(s) 26 may be located and oriented to project light onto a sign 18 hanging from the crossarm 16. In another embodiment, the light(s) 26 may be located and oriented to project light onto a sign 18 mounted onto the crossarm 16. In another embodiment, the light(s) 26 may be located and oriented to project light onto a sign 18 mounted to the vertical member 14 or another part of the sign post 12. In another embodiment, the light(s) 26 may be located and oriented to project light onto the sign post 12 itself.

Figure 7A:
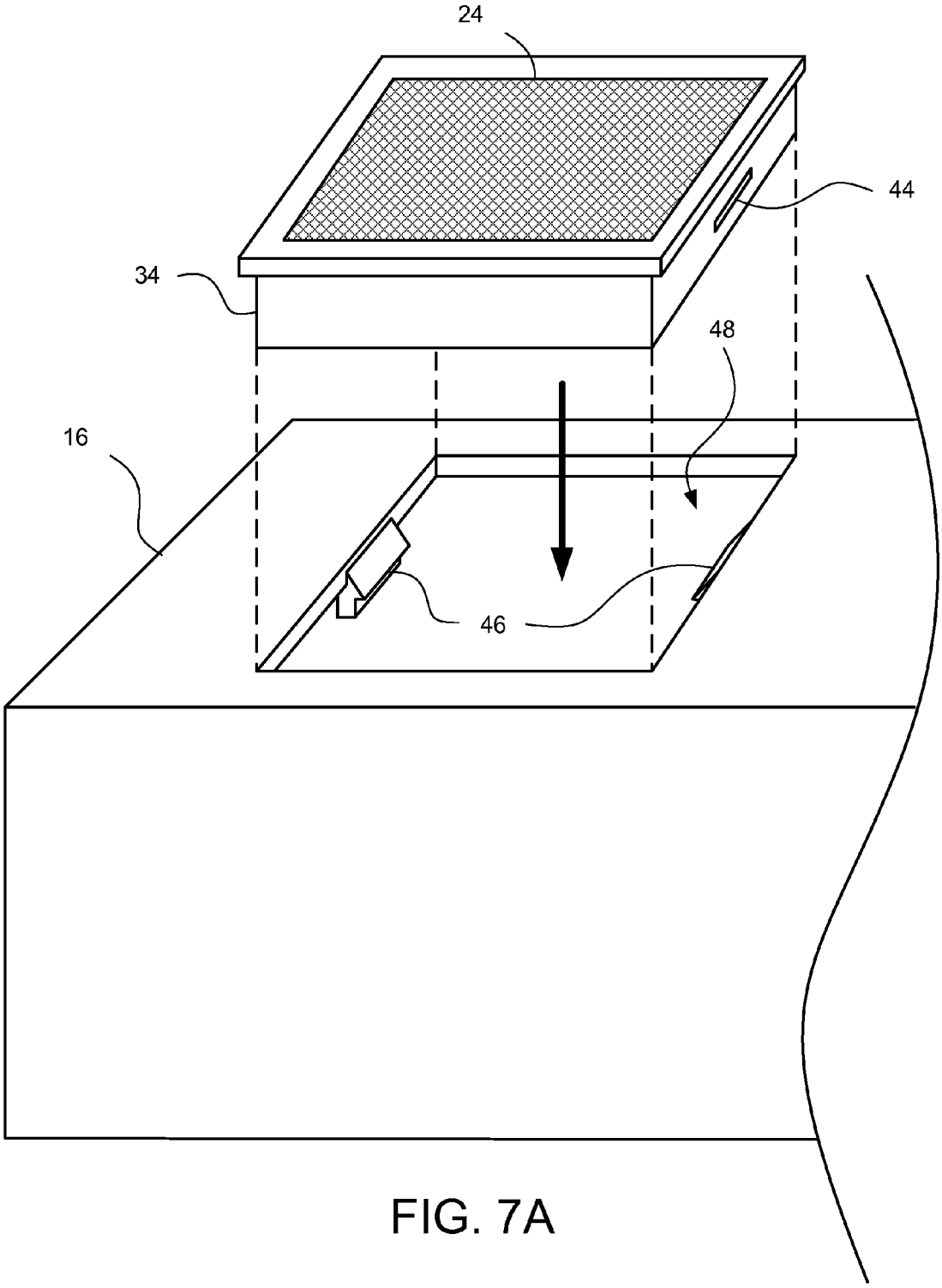
FIG. 7A is a schematic diagram illustrating an exploded view of one embodiment of a solar light sign post assembly.

FIG. 7A depicts an exploded view of one embodiment of a solar light sign post 10 assembly. The illustrated assembly includes a solar panel 24, battery compartment 34, and a crossarm 16. Other components are omitted for clarity, but may be configured in a manner similar to or different from the illustrated components. In one embodiment, the solar panel 24 serves as a cover for the battery compartment 34. The battery compartment 34 includes one or more notches 44 that align with one or more locking catches 46 coupled to the cutout 48 in the crossarm 16. The locking catches 46 may be integrally formed with the crossarm 16, in one embodiment, or attached to the crossarm 16. For example, the locking catches 46 may be coupled to a ring (not shown) that may be inserted into the cutout 48. The notches 44 and locking catches 46 align so that when the battery compartment 34 is inserted into the crossarm cutout 48 then the locking catches 46 engage the corresponding notches 44 to hold the battery compartment 34 and solar panel 24 within or against the crossarm 16. Similar mounting arrangements may be implemented to assemble the light housings 36 in the crossarm 16. Alternatively, other assembly hardware such as adhesives, screws, snaps, clasps, or fasteners may be used to install the battery compartment 34, light housing 36, or solar panel 24 into or on the crossarm 16.

Figure 7B:
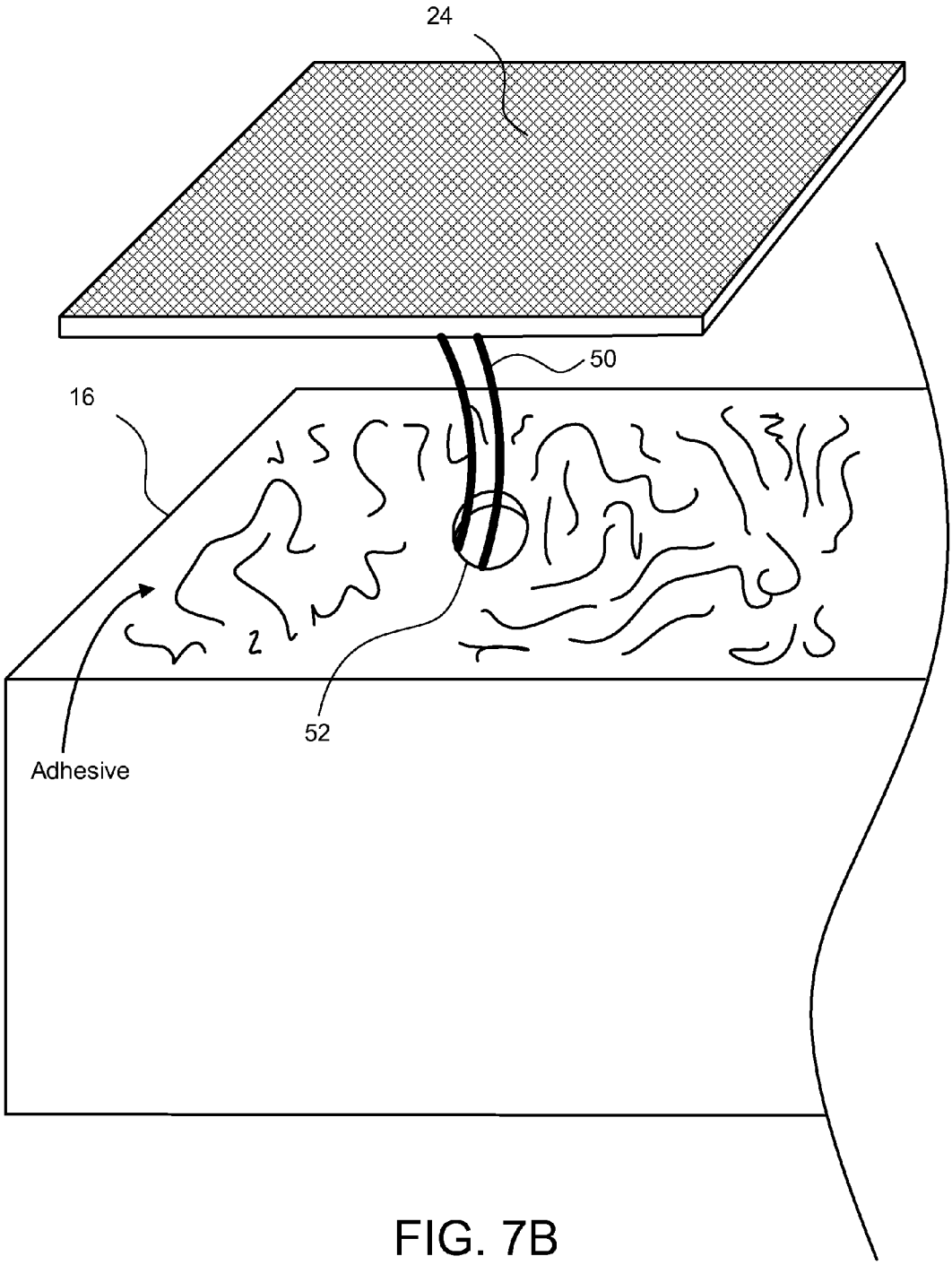
FIG. 7B is a schematic diagram illustrating another embodiment of a solar light sign post assembly.

FIG. 7B is a schematic diagram illustrating another embodiment of a solar light sign post 10 assembly. The illustrated assembly includes a solar panel 24 and a crossarm 16. Other components are omitted for clarity, but may be configured in a manner similar to or different from the illustrated components. In one embodiment, the solar panel 24 is directly adhered to a surface such as the top of the crossarm 16. Wires 50 from the solar panel 24 are directed through a hole 52 in the surface of the crossarm 16. In one embodiment, the hole 52 is covered by the solar panel 24 once the solar panel 24 is adhered to the crossarm.

Figure 8A:
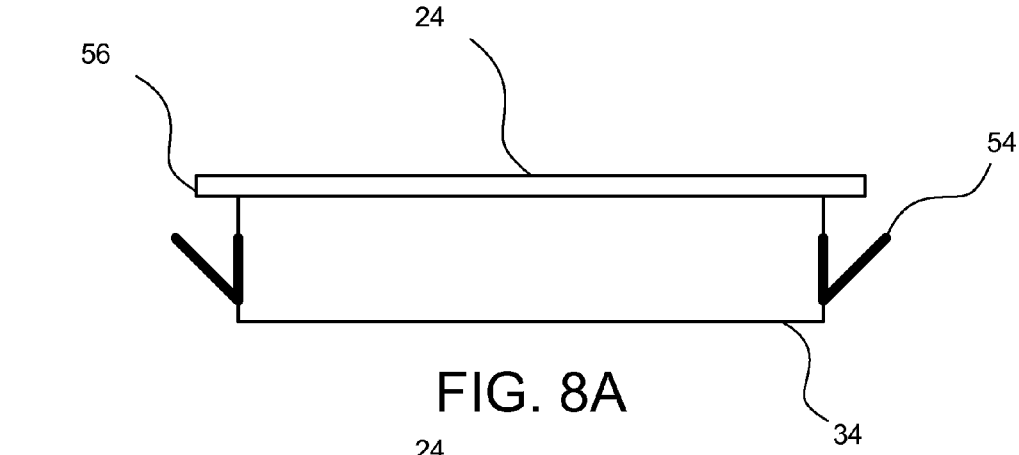
FIGS. 8A-C are schematic diagrams illustrating one embodiment of an attachment clip of a solar light device.
Figure 8B:
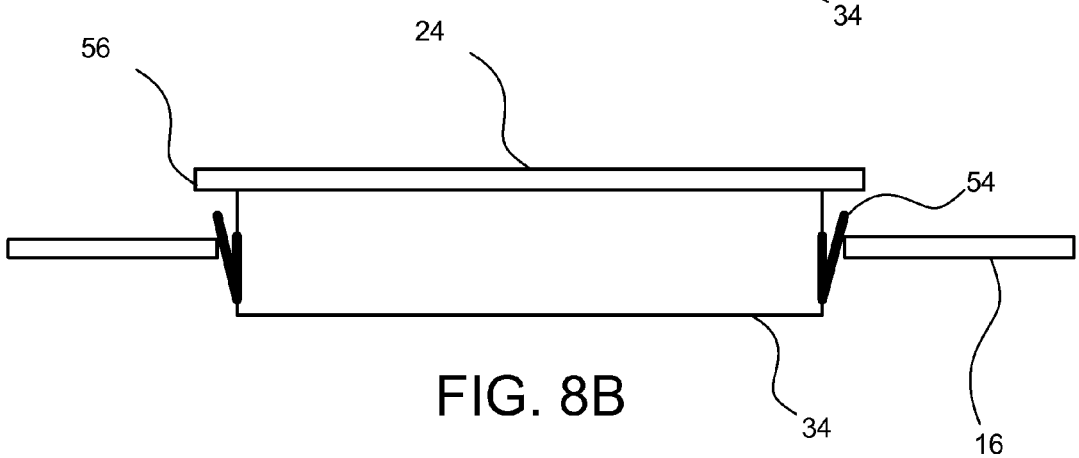
Figure 8C:
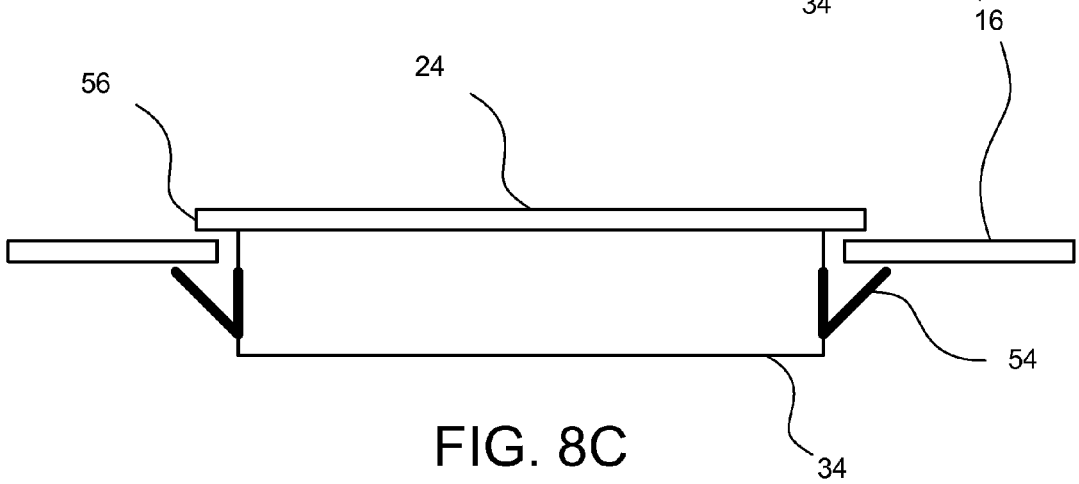

FIGS. 8A-C depict one embodiment of an attachment clip 54 of a solar light 24 device. The attachment clip 54 also may be referred to as a locking catch. The illustrated attachment clip 54 is coupled the battery compartment 34 and solar panel 24. In one embodiment, the solar panel 24 serves as a cover for the battery compartment 34, as described in relation to FIG. 7A above. The solar panel 24 also includes a flange 56 that is larger extends beyond the battery compartment 34 and may serve to rest against the outer surface of the topside of the crossarm 16, as explained below.

FIG. 8B specifically shows the battery compartment 34 partially inserted into the crossarm cutout 48 in the direction indicated by the arrow. As the battery compartment 34 and attachment clips 54 are inserted through the crossarm cutout 48, the attachment clips 54 engage against the sides of the crossarm cutout 48 to compress the attachment clips 54 so that the battery compartment 34 may be recessing into the crossarm 16.

FIG. 8C specifically shows the battery compartment 34 inserted into the crossarm cutout 48. In the illustrated embodiment, the flange 56 of the solar panel 24 engages against the topside of the crossarm 16 and the attachment clip 54 engages against the opposite side of the same wall of the topside of the crossarm 16. In this manner, the solar panel 24 and battery compartment 34 may be temporarily or permanently secured to the crossarm 16. Similar mounting arrangements may be implemented for the light housings 36.

The light housing(s) 36 other components of the solar light sign post 10 may be attached similarly to the attachment methods shown and described with reference to the previous figures. In another embodiment, one or more components may be temporarily or permanently secured to the sign post 12 in another manner using similar or other types of fasteners, including glue, screws, silicone, or other fasteners.

Figure 9:
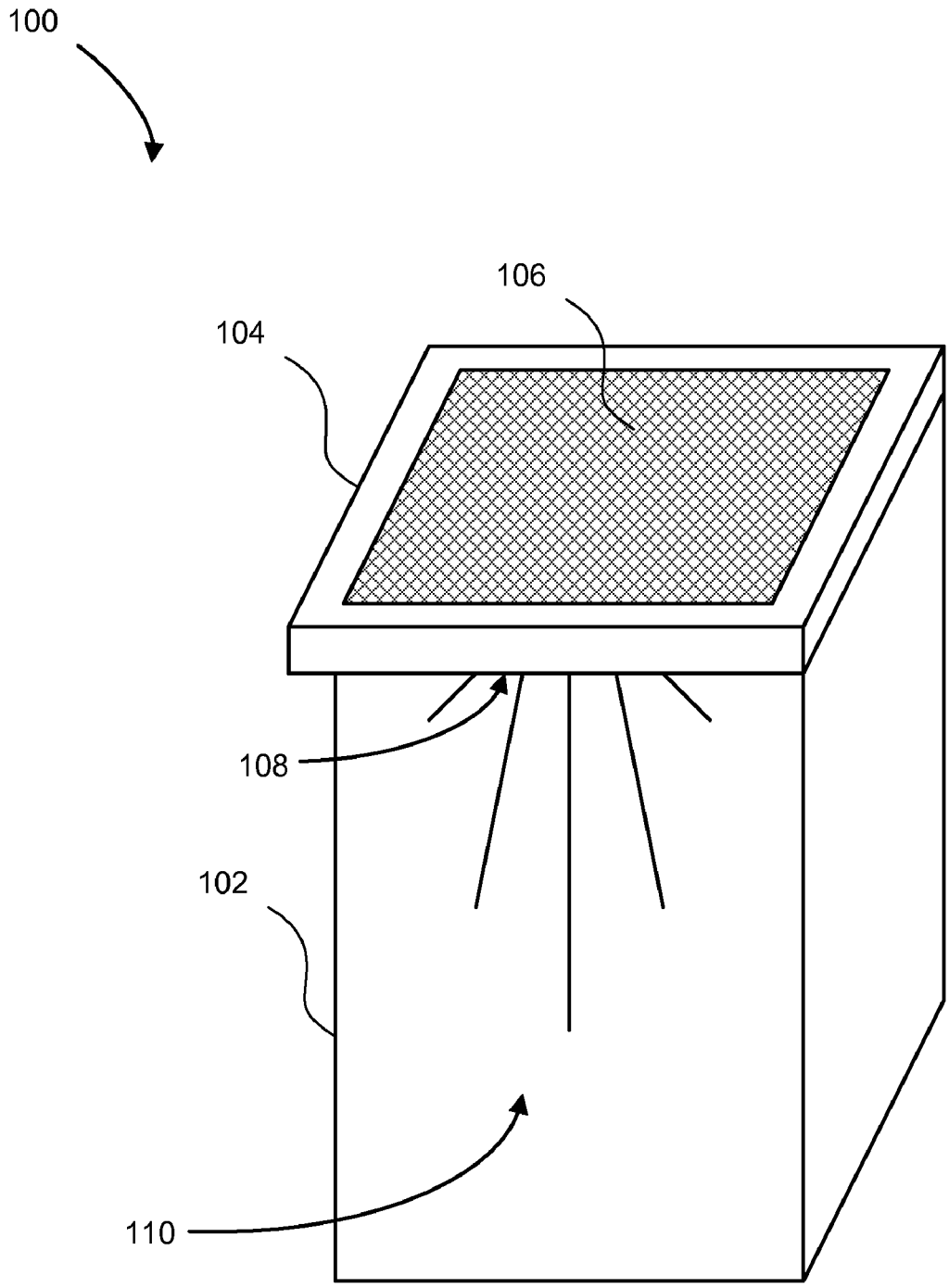
FIG. 9 is a schematic diagram illustrating one embodiment of a solar light flyer box.

FIG. 9 depicts one embodiment of a solar light flyer box 100. The illustrated solar light flyer box 100 includes a flyer box 102 having a lid 104. A solar panel 106 is mounted on or within the lid 104 and coupled to a light source 108 that projects light onto the flyer box 102. In one embodiment, the light source 108 is located on the underside of the lid 104 and configured to project light onto the front panel 110 of the flyer box 102. In one embodiment, the solar panel 106, light source 108, and other related circuitry (not shown), including one or more rechargeable batteries, may be substantially similar to the components described above. In one embodiment, the flyer box 102 may be mounted to a post (not shown) such as a sign post or a dedicated post.

Figure 10:
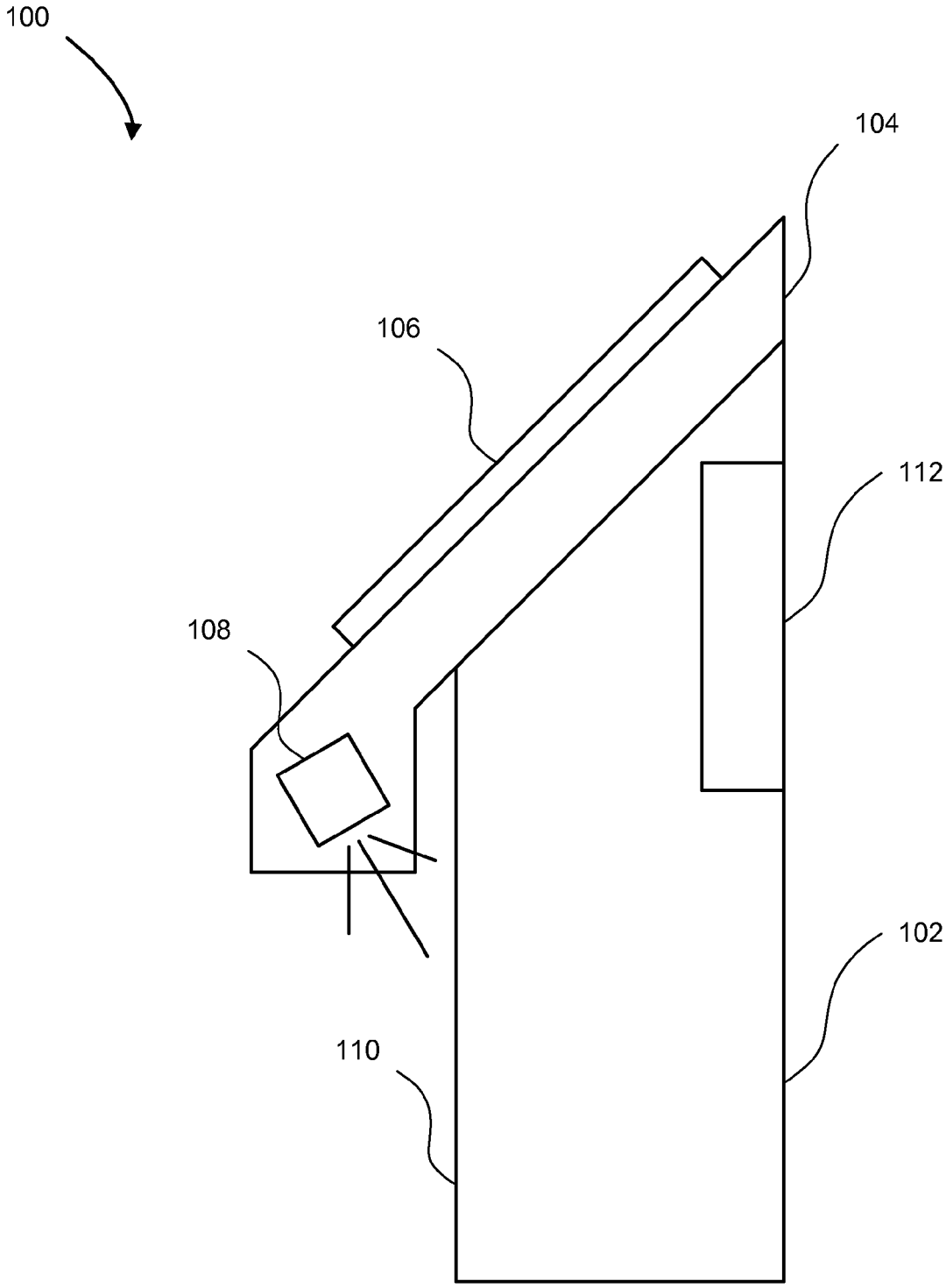
FIG. 10 is a schematic diagram illustrating a side view of the solar light flyer box of FIG. 9.

FIG. 10 depicts a side view of the solar light flyer box 100 of FIG. 9. In particular, FIG. 10 shows the flyer box 102, the lid 104, the solar panel 106, and the light source 108 mounted within a housing on the underside of the lid 104. The lid 104 extends beyond the front panel 110 of the flyer box 102 so that the light source 108 such as an LED may project light onto the front panel 110. The illustrated solar light flyer box 100 also includes a battery compartment 112, which may be mounted within the flyer box 102 as shown, or on the outside of the flyer box 102, the lid 104, a stand, a post, or another device.

Figure 11:
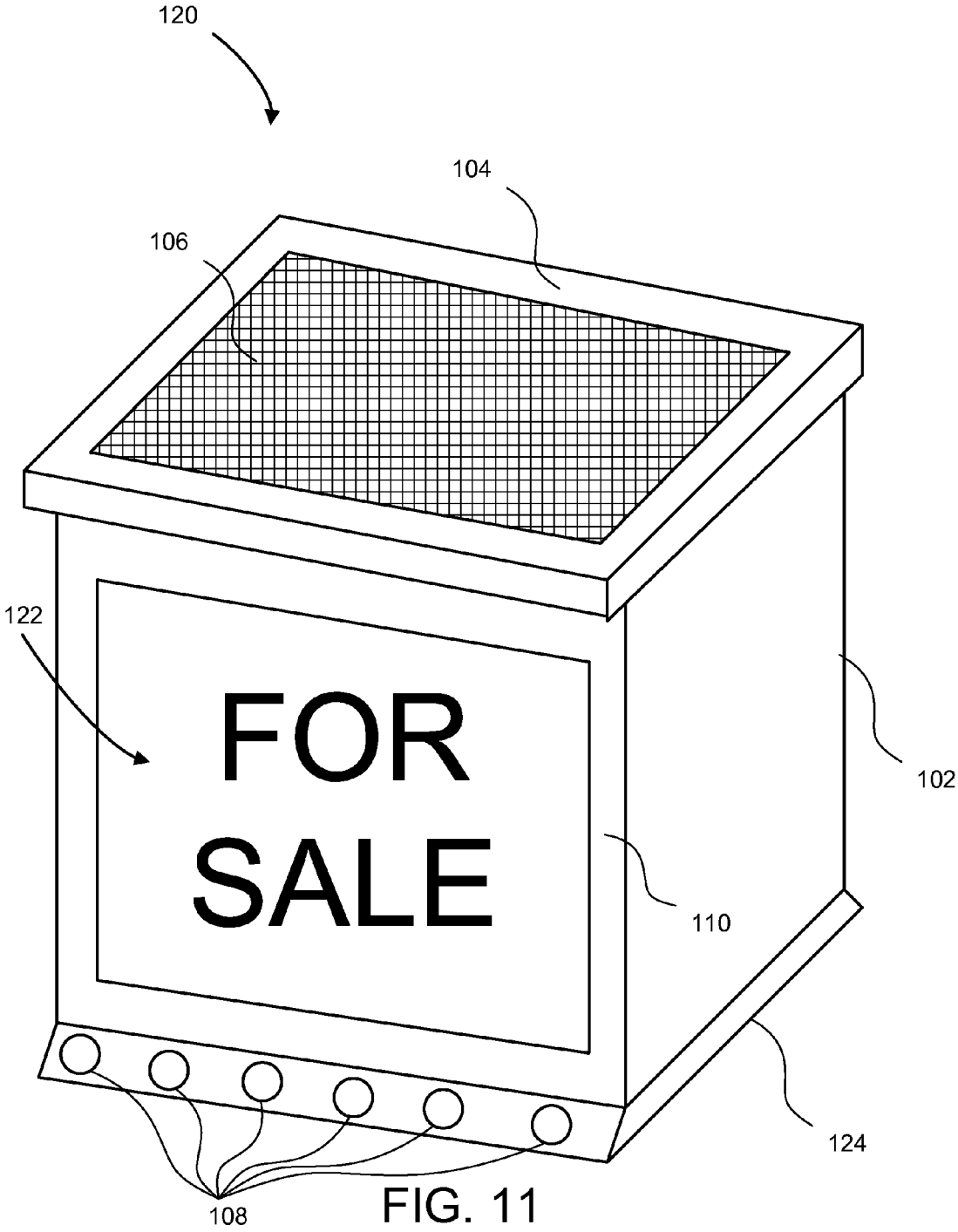
FIG. 11 is a schematic diagram illustrating another embodiment of a solar light flyer box with edge-lighting.

FIG. 11 depicts another embodiment of a solar light flyer box 120. The illustrated solar light flyer box 120 implements edge-lighting to light an image 122 etched or otherwise marked on the front panel 110 of the flyer box 102. Alternatively, the image 122 may be marked on another part of the flyer box 102 or lid 104. The image 122 shown is the phrase "FOR SALE" etched into the front panel 110, which may be made of glass, plastic, or another transparent or translucent material.

The image 122 may be lit from light emitted from one or more light sources 108 such as LEDs that project light into the edge of the panel 110. For example, one or more LEDs may project light from the bottom of the front panel 110 into the front panel 110 to light up the image 122. The one or more lights 108 may be located within a light base 124 attached to the bottom of the flyer box 102. In alternative embodiments, the lights 108 may be mounted and configured to project light into one or more panels and/or the light 108 from another position other than the base 124. For example, one or more light sources 108 may be mounted within a side panel of the flyer box 102 to project light into a side edge of the flyer box 102.

Figure 12A:
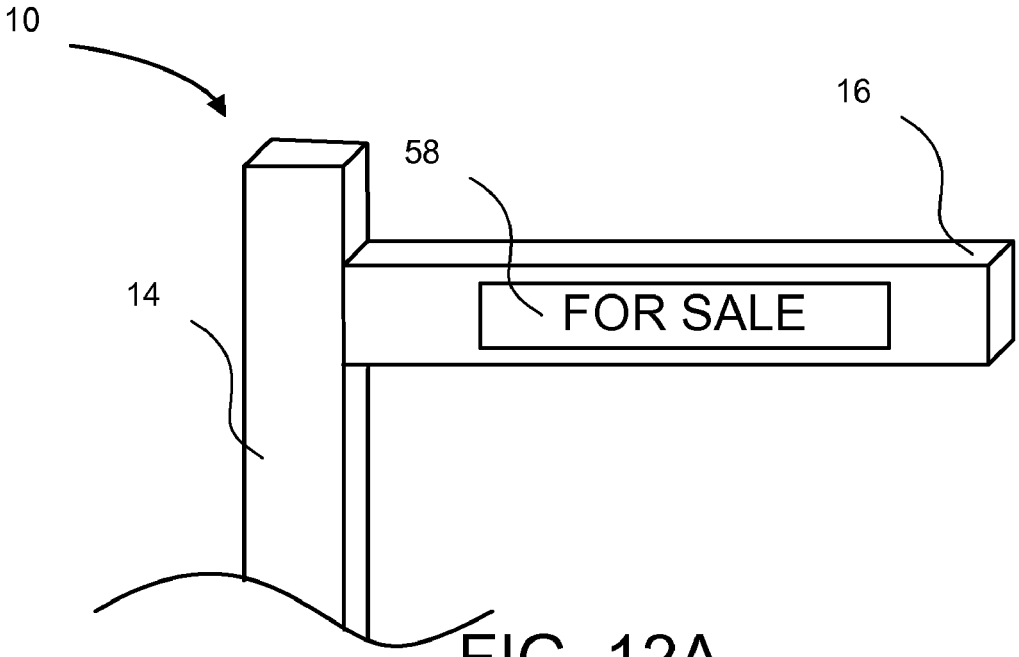
FIG. 12A illustrates another embodiment of a solar light sign post with a backlight panel built into the crossarm.

FIG. 12A illustrates another embodiment of a solar light sign post 10 with a backlit panel 58 built into the crossarm 16. For clarity, many of the solar components are omitted, but may be configured in a manner similar to or different from the illustrated components. The depicted solar light sign post 10 includes a backlit panel 58 that may be partially or wholly translucent or semi-translucent so that a light source 26 mounted behind the backlit panel 58 (i.e., within the crossarm 26) may illuminate the backlit panel 58. In one embodiment, the solar light sign post 10 may be configured to allow a user to easily exchange different backlit panels 58 within the crossarm 16.

Figure 12B:
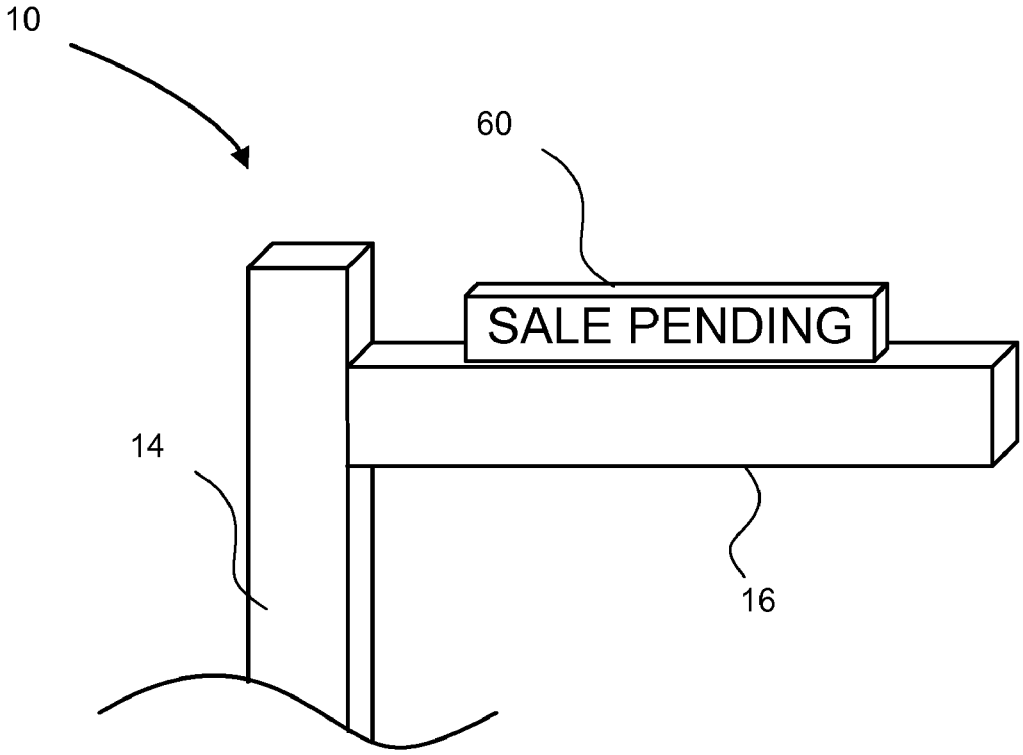
FIG. 12B illustrates another embodiment of a solar light sign post with an edge-lit rider sign.

FIG. 12B illustrates another embodiment of a solar light sign post 10 with an edge-lit rider sign 60. For clarity, many of the solar components are omitted, but may be configured in a manner similar to or different from the illustrated components. The depicted solar light sign post 10 includes an edge-lit rider sign 60 that may be etched with an image, as described above, so that the edge-lighting illuminates the image. In one embodiment, the light source 26 to illuminate the rider sign 60 is located within the crossarm 16. In some embodiments, the solar light sign post 10 may be configured to allow a user to easily exchange different edge-lit rider signs 60 on the crossarm 16.

Some embodiments of the solar lighting sign post 10 use different types of solar cells or solar panels 24. For example, some embodiments use crystalline solar cells such as monocrystalline or polycrystalline solar cells. Other embodiments use amorphous solar cells or another type of solar cell.

In another embodiment, an apparatus includes means for mounting a sign; means for defining a cavity within the mounting means; and means for illuminating the sign from within the cavity.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus, comprising:

a photovoltaic cell to collect solar energy and to convert the solar energy into electrical energy, wherein the photovoltaic cell is integrated with a sign post;

a power storage module coupled to the photovoltaic cell, the power storage module having a rechargeable battery to store at least some of the electrical energy;

a light source coupled to the power storage module by control circuitry, wherein the light source is at least partially recessed in the sign post; and a light source housing to enclose the light source, wherein the light source housing is at least partially recessed in the sign post and has dimensions approximately equal to a lighting aperture in the sign post.

2. The apparatus of claim 1, wherein the sign post comprises a vertical member and a horizontal member, and the light source is at least partially recessed in either the vertical member or the horizontal member.

3. The apparatus of claim 1, wherein the photovoltaic cell comprises a crystalline solar cell, and the photovoltaic cell is adhered directly to a top, substantially horizontal surface of the sign post, and the photovoltaic cell is coupled to the power storage module by at least one wire which enters an interior space of the sign post through a hole beneath the photovoltaic cell.

4. The apparatus of claim 3, wherein the light source is fully recessed into the interior space of a horizontal member of the sign post.

5. The apparatus of claim 4, further comprising a lens assembly integrated with the light source housing, the light source housing coupled to the sign post, the lens assembly to align with a lighting aperture in horizontal member of the sign post.

6. The apparatus of claim 5, wherein the light source is oriented within the interior space of the horizontal member of the sign post to illuminate a sign mounted to the sign post.

7. The apparatus of claim 1, wherein the light source is oriented within an interior space of the sign post to provide backlight illumination for a partially translucent panel mounted approximately at an aperture in the sign post.

8. The apparatus of claim 1, further comprising a fastener to secure the light source housing within the sign post.

9. The apparatus of claim 8, wherein the fastener comprises a compressible attachment clip, the compressible attachment clip to compress during insertion of the light source housing into the sign post and to return to engage against an inside surface of the sign post to secure the light source housing within the sign post.

10. The apparatus of claim 1, wherein the light source housing is further configured to house the power storage module.

11. The apparatus of claim 1, further comprising another housing to house the power storage module.

12. The apparatus of claim 1, further comprising a separate housing to house the photovoltaic cell and the power storage module.

13. An apparatus, comprising:

a flyer box to hold a flyer;

a solar cell coupled to the flyer box; and a light source coupled to the solar cell, the light source to illuminate at least a portion of the flyer box.

14. The apparatus of claim 13, wherein the light source is oriented to project illumination on a front panel of the flyer box.

15. The apparatus of claim 13, wherein the light source is oriented to edge-light a panel of the flyer box.

16. The apparatus of claim 13, wherein the solar cell and light source are coupled to a lid of the flyer box.

17. An apparatus comprising:

a crossarm of a sign post, wherein the crossarm has a non-rectangular cross-sectional geometry with at least one side surface at a non-vertical angle;

a photovoltaic cell mounted to the side surface at the non-vertical angle, the photovoltaic cell to collect solar energy and to convert the solar energy into electrical energy;

a power storage module coupled to the photovoltaic cell, the power storage module comprising a rechargeable battery to store at least some of the electrical energy; and a light source coupled to the power storage module by control circuitry, wherein the light source is at least partially recessed in the sign post and oriented to illuminate a sign below the crossarm of the sign post.

18. The apparatus of claim 17, wherein the crossarm has a trapezoidal cross-sectional geometry.

19. The apparatus of claim 17, further comprising another photovoltaic cell mounted to a substantially horizontal top surface of the crossarm of the sign post.

* * * * *